US005697577A

United States Patent [19]

Ogden

[11] Patent Number: 5,697,577

[45] Date of Patent: Dec. 16, 1997

[54] PREMOISTENED TOILET PAPER DISPENSER

[76] Inventor: Terry P. Ogden, 4591 Porter Ave., Ogden, Utah 84403

[21] Appl. No.: 607,711

[22] Filed: Feb. 27, 1996

[51] Int. Cl.[6] ..... A47K 10/38

[52] U.S. Cl. ..... 242/598.6; 242/596.8; 242/599.3

[58] Field of Search ..... 242/597.8, 596, 242/596.7, 596.8, 599.3; 8/598.5, 598.6; 225/43, 46, 52; 219/214, 521

[56] References Cited

U.S. PATENT DOCUMENTS

| | | | |
|---|---|---|---|
| 2,440,974 | 5/1948 | Resch | 242/598.6 |
| 2,561,584 | 7/1951 | McDonald | 242/599.3 |
| 3,729,145 | 4/1973 | Koo et al. | 242/596.8 |
| 3,786,615 | 1/1974 | Bauer | 53/21 FC |
| 3,895,474 | 7/1975 | Bauer | 53/21 FC |
| 3,947,134 | 3/1976 | Ogawa . | |
| 4,004,711 | 1/1977 | Ravich . | |
| 4,089,481 | 5/1978 | Ciuci | 242/599.3 |
| 4,421,973 | 12/1983 | Lou . | |
| 4,495,402 | 1/1985 | Burdick et al. . | |
| 4,508,959 | 4/1985 | Lüscher . | |
| 4,694,973 | 9/1987 | Rose et al. . | |
| 4,700,048 | 10/1987 | Levy . | |
| 4,721,264 | 1/1988 | Muscarello | 242/598.6 |
| 4,827,107 | 5/1989 | Peery | 219/521 |
| 4,857,708 | 8/1989 | DeMars | 219/521 |
| 4,865,221 | 9/1989 | Jackson et al. | 221/48 |
| 4,890,205 | 12/1989 | Schaffer . | |
| 4,943,705 | 7/1990 | Halloran | 219/521 |
| 4,947,026 | 8/1990 | Groom et al. | 219/214 |
| 5,006,690 | 4/1991 | Cole et al. | 219/521 |
| 5,050,737 | 9/1991 | Joslyn et al. . | |
| 5,143,249 | 9/1992 | Saint Criq et al. . | |
| 5,210,396 | 5/1993 | Sanders | 219/521 |
| 5,231,266 | 7/1993 | Warren | 219/521 |
| 5,310,084 | 5/1994 | Pittman . | |
| 5,311,986 | 5/1994 | Putz | 242/598.5 |

FOREIGN PATENT DOCUMENTS

| | | | |
|---|---|---|---|
| 2 168 031 | 6/1986 | United Kingdom | 242/598.6 |

*Primary Examiner*—John P. Darling

*Attorney, Agent, or Firm*—Workman, Nydegger & Seeley

[57] ABSTRACT

A housing is provided having an interior surface defining a chamber. The chamber is sized to receive a pre-moistened toilet paper roll. The chamber is substantially sealed to help prevent the evaporation of the moisture on the toilet paper roll. The housing includes a first end wall, an opposing second end wall, and a tubular side wall extending therebetween. The tubular side wall comprises a C-shaped tube having a first lip and an opposing second lip defining an opening extending therebetween. A door is slidably mounted on the interior surface of the C-shaped tube to selectively cover the opening. By opening the door, the toilet paper positioned within the housing can be dispensed for use. Mounted on the interior surface of the C-shaped tube is a heating pad for warming the moistened toilet paper. A compartment extends off of the housing and includes batteries that are electrically connected to the heating pad for energizing the heating pad. In an alternative embodiment, a light bulb can be positioned within the compartment for heating of the moistened toilet paper.

36 Claims, 4 Drawing Sheets

PREMOISTENED TOILET PAPER DISPENSER

BACKGROUND OF THE INVENTION

1. The Field of the Invention

The present invention relates to apparatus for dispensing toilet paper, more specifically, the present invention relates to apparatus for dispensing pre-moistened toilet paper.

2. The Relevant Technology

Toilet paper is commonly used to clean the rectum after having a bowel movement. Since this process deals with the handling of human feces, it is easy for an individual's hands to become contaminated from the feces. Failure to properly clean the contaminated hands, such as by washing with soap and hot water, can easily result in the transfer of contamination. This problem is especially important with respect to individuals involved in public service. For example, failure of restaurant employees to clean their hands after going the bathroom can result in contamination of the food being served. Likewise, failure of medical practitioners to properly clean their hands can result in transferring bacteria to patients.

Conventional toilet paper is a dry, loosely woven, fibrous material that easily decomposes in water. This is to help insure that the toilet paper easily flushes in the toilet. Toilet paper is predominately wood fibers and, as such, does not work to disinfect the user's hands. Rather, toilet paper is used to limit contact of the hands with the feces.

One problem often encountered with toilet paper is that it can be abrasive to the walls of the rectum. This is especially true for infants who often obtain rashes. The problem is also encountered in adults who can suffer from chafing or the irritation of hemorrhoids. One approach for remedying this problem in infants has been to use pre-moistened tissues. Such tissues typically come in a separate dispenser. The added moisture helps to soften the paper and make it easier to clean the infant.

The use of pre-moistened tissue, however, also has its problems. For example, a wet tissue can often be cold and clammy, making it uncomfortable to a child or user. Furthermore, since the tissues are in a separate container, the tissues may be inappropriately positioned for use by adults.

OBJECTS AND SUMMARY OF THE INVENTION

Accordingly, it is an object of the present invention to provide improved apparatus for dispensing toilet paper.

It is another object of the present invention to provide apparatus for dispensing pre-moistened toilet paper.

Another object of the present invention is to provide apparatus for warming the moistened toilet paper so as to minimize the discomfort of the moistened toilet paper.

Yet another object of the present invention is to provide apparatus for dispensing toilet paper that will minimize the spread of germs, especially when an individual fails to wash their hands.

Finally, another object of the present invention is to provide the above apparatus configured to fit within a conventional toilet paper holder so as to be conveniently used.

These and other objects, features, and advantages of the present invention will become more fully apparent from the following description and appended claims, or may be learned by the practice of the invention as set forth hereinafter.

To achieve the foregoing objects, and in accordance with the invention as embodied and broadly described herein, a housing is provided having an interior surface defining a chamber. The chamber is sized to receive a pro-moistened toilet paper roll. The chamber is substantially sealed to help prevent evaporation of moisture on the toilet paper roll. The housing is further defined as having a first end wall, an opposing second end wall, and a tubular side wall extending therebetween. The tubular side wall comprises a C-shaped tube having a first lip and an opposing second lip with an opening extending therebetween. A door is slidable mounted on the interior surface of the C-shaped tube. The door selectively covers the opening.

The first end wall is removable to define an access for insertion of the toilet paper into the chamber. A rod extending from the second end wall of the housing projects into the chamber. The rod is used for holding the toilet paper roll as the toilet paper is dispensed. More specifically, the toilet paper has a passageway longitudinally extending therethrough. The passageway is sized to receive the rod as the toilet paper is positioned within the chamber of the housing. Once the toilet paper roll is positioned within the chamber, the first end wall can be repositioned to substantially seal the chamber closed. The door can then be raised to allow an opening through which the toilet paper can be dispensed.

Although the toilet paper can be dry, in the preferred embodiment the toilet paper is moistened or saturated with substances such as water, bacteriostatic agents, antibacterial agents, lotions, or combinations thereof.

One of the novel features of the present invention is that it can be attached to a conventional toilet paper holder. As such, the present apparatus can be used without any home remodeling or additional fixed structures required. Conventional toilet paper holders comprise adjacent arms which have interior faces having recesses formed therein. In traditional uses, a collapsible member is positioned between the recesses to hold the toilet paper in position. In the present invention, opposing fingers are positioned on opposing sides of the housing. At least one of the fingers is collapsible enabling the fingers to be selectively positioned within the opposing recesses, thereby securing the housing to the conventional toilet paper holder.

Another important aspect of the present invention is the means for heating the pre-moistened toilet paper within the chamber of the housing. This can be accomplished in a number of alternative embodiments. For example, the heating pad can be positioned on the interior surface of the C-shaped tube. A compartment extending off of the housing can hold batteries for energizing the electrical pad. In alternative embodiments, the compartment can include both batteries and a light bulb. The light bulb can be used as a heat source for warming the toilet paper within the chamber of the housing.

BRIEF DESCRIPTION OF THE DRAWINGS

In order that the manner in which the above-recited and other advantages and objects of the invention are obtained will be understood, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
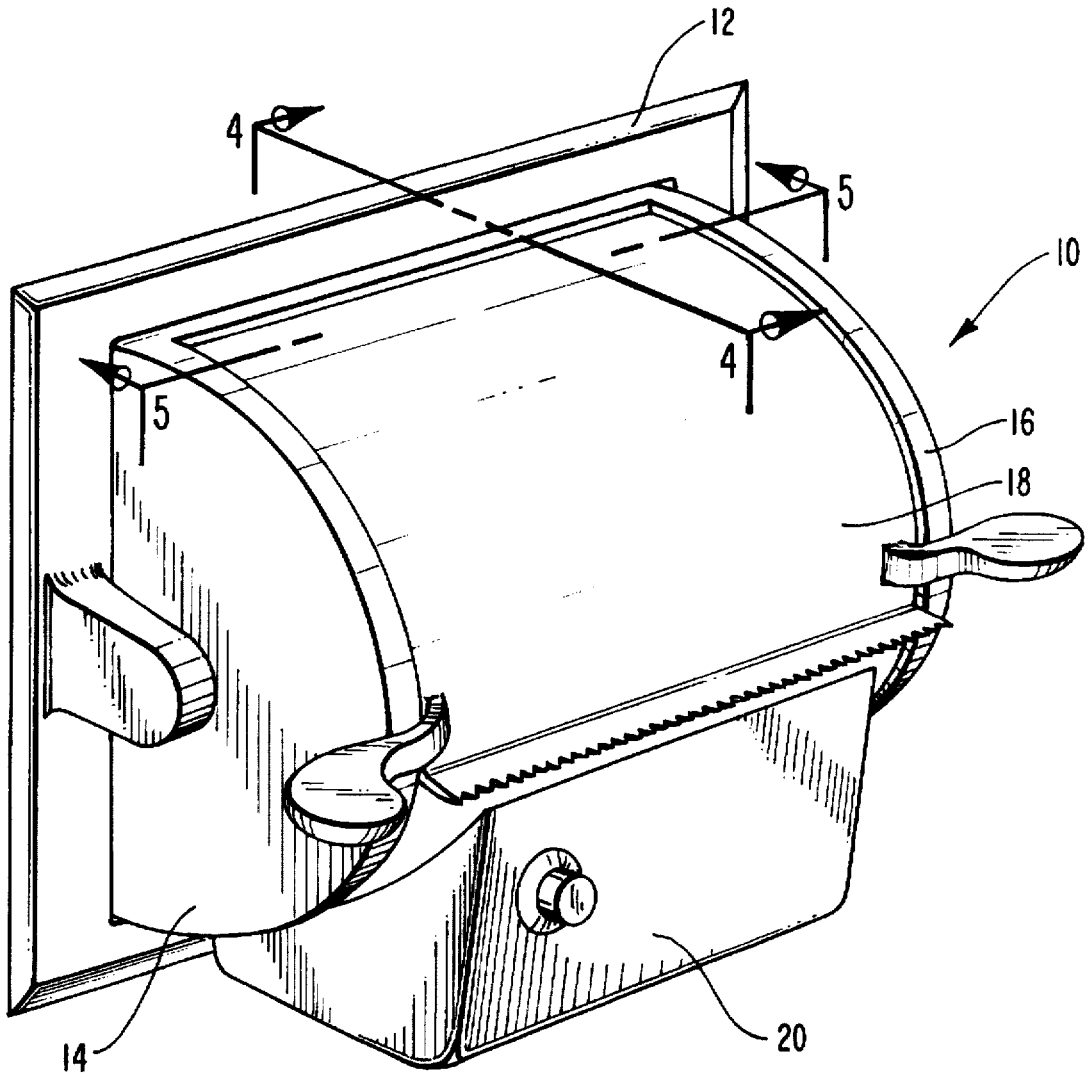
FIG. 1 is a perspective view of the inventive housing used to hold pre-moistened toilet paper, the housing being secured to a conventional toilet paper holder.

The present invention relates to apparatus for dispensing toilet paper and, more specifically, apparatus for dispensing pre-moistened toilet paper. Depicted in FIG. 1 is a housing 10 selectively secured to a conventional toilet paper holder 12. Housing 10 is used to hold and dispense toilet paper or pre-moistened toilet paper. Housing 10 is shown as having a first end wall 14, an opposing second end wall 16, and a tubular side wall 18 extending therebetween. Projecting from sidewall 18 is a hollow compartment 20 that will be discussed later in greater detail.

Figure 2:
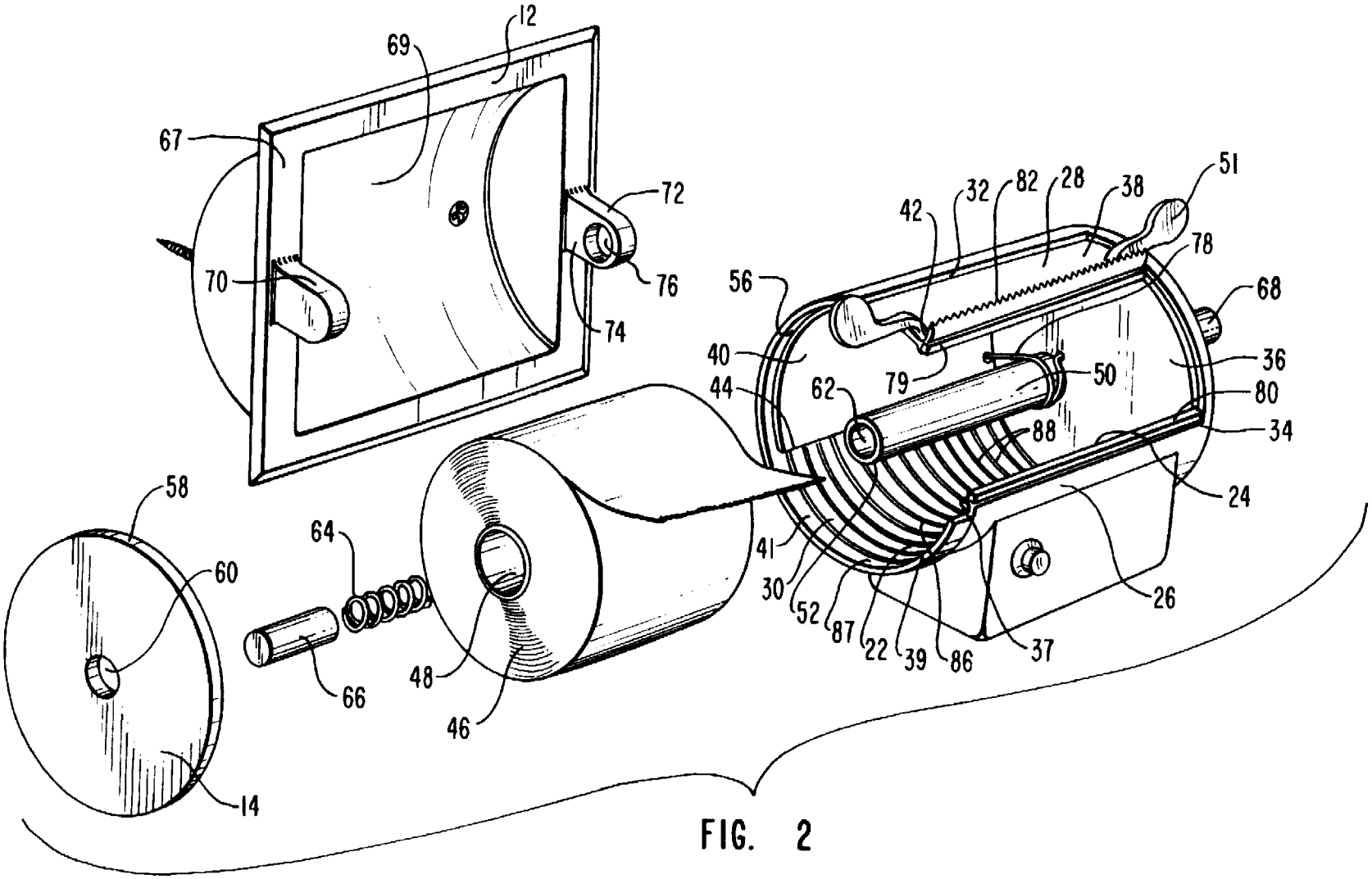
FIG. 2 is an exploded view of the housing shown in FIG. 1 showing toilet paper being disposed therein.

The present invention provides means for selectively forming an opening in the housing through which the pre-moistened toilet paper can be dispensed. FIG. 2 is an exploded view of the housing 10 shown in FIG. 1. As disclosed therein, sidewall 18 has a substantially cylindrical interior surface 22 that defines a holding chamber 24. Holding chamber 24 is bounded on opposing sides by first end wall 14 and second end wall 16. In the preferred embodiment, as shown in FIG. 2, sidewall 18 is shown as comprising an elongated C-shaped tube 26 having a door 28 slidably mounted thereon. C-shaped tube 26 has an interior surface 30 extending between a first lip 32 and an opposing second lip 34. An opening 36 is defined as extending between first lip 32 and second lip 34.

Door 28 is shown as comprising an exterior surface 38 and an interior surface 40. Door 28 further has a leading edge 42 and a trailing edge 44. Door 28 is mounted so that exterior surface 38 of door 28 slidably retracts on interior surface 30 of C-shaped tube 26. In this embodiment, leading edge 42 of door 28 slides between first lip 32 and second lip 34 of C-shaped tube 26, thereby effectively opening and closing opening 36. C-shaped tube 26 also has a side edge 37 with an enlarged diameter rim 39 projecting therefrom. Rim 39 defines a side access 41 to chamber 24.

FIG. 2 also discloses a toilet paper roll 46 having a leading end 47. Roll 46 can be a conventional roll of toilet paper. In the preferred embodiment, however, roll 46 comprises a pre-moistened tissue moistened with water. The tissue must be sufficiently strong such that when the tissue is wet, the tissue can be removed and used for its intended purpose without substantially falling apart. In yet another alternative embodiment, roll 46 can be moistened or substantially saturated with a aqueous bacterial static agent such as chlorhexidine. Such tissue helps to prevent the spread of bacteria. This is especially true when the user forgets to wash their hands. In another embodiment, roll 46 can be moistened with a lotion to help reducing chafing or rashes on the skin.

As depicted in FIG. 2, roll 46 has a passageway 48 extending through the longitudinal axis of roll 46. The present invention also provides means positioned within chamber 24 for holding roll 46 of moistened toilet paper so that roll 46 rotates freely as the toilet paper is dispensed from housing 10. By way of example, not by limitation, depicted in FIG. 2 is a cylindrical rod 50 projecting from second end wall 16 so as to extend within chamber 24. Rod 50 has a freely exposed end 52 and is sized to be received within passageway 48 so that roll 46 can freely rotate thereabout. To facilitate the positioning of roll 46 onto rod 50, side access 41 is sized to allow roll 46 to pass therethrough and into chamber 24.

In alternative embodiments, by way of example and not by limitation, the means positioned within chamber 24 for holding roll 46 can comprise rod 50 extending from first end wall 14 or a pair of short aligned rods extending from each of the end walls 14 and 16.

Once rod 50 is received within passageway 48 so that roll 46 is housed within chamber 24, first end wall 14, that is selectively removable from housing 10, can be secured to sidewall 18. Rim 39 of C-shaped tube 26 has an inside diameter 56 that is sized to snugly receive outside edge 58 of first end wall 14, thereby making a substantially sealed connection between end wall 14 and sidewall 18.

Figure 3:
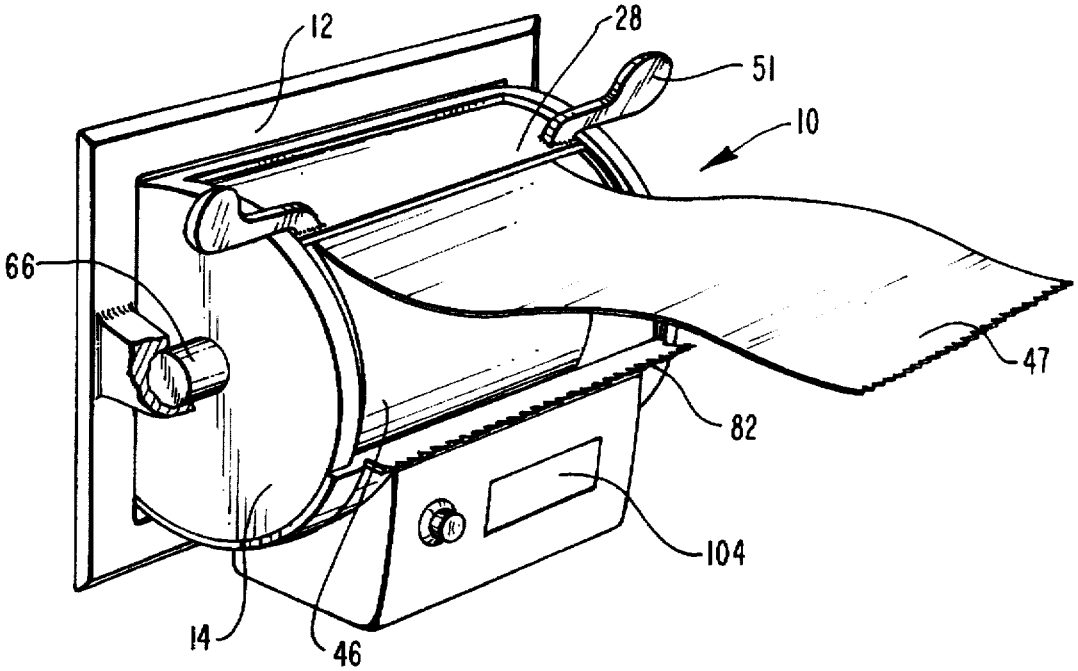
FIG. 3 is one embodiment of the housing shown in FIG. 1 having a door opened for dispensing the toilet paper housed therein.

The present invention also provides means for attaching housing 10 to holder 12. By way of example and not by limitation, first end wall 14 has an access 60 extending therethrough and aligned with rod 50. Rod 50 is also shown as having a recess 62 extending within free end 52. Recess 62 is sized to receive a resilient spring 64 and a first finger 66 such that first finger 66 can be resiliently compressed within rod 50. In its normal position as shown in FIG. 3, first finger 66 is biased by spring 64 to project from first end wall 14 through access 60. Referring back to FIG. 2, also aligned with rod 50 and projecting away from second end wall 16 is a second finger 68. In one embodiment, second finger 68 could comprise the opposing end of rod 50.

Holder 12 is shown in FIG. 2 as comprising a frame 67 having a recessed back 69. A pair of arms 70 and 72 project from frame 67. Each of arms 70 and 72 have an interior face 74 with an annular recess 76 extending therein. First finger 66 and second finger 68 each have an outside diameter sized to be received within recesses 76. Accordingly, by compressing retraction rod 66, first finger 66 and second finger 68 can be received within opposing recesses 76. Spring 64 produces a bias against retraction rod 66 that holds first finger 66 and second finger 68 within opposing recesses 76, thereby securing housing 10 to holder 12 as shown in FIG. 3.

The present invention also envisions a plurality of alternative embodiments for the means for attaching housing 10 to holder 12. By way of example and not by limitation, rod 50 could be solid while first finger 66 is tubular having an opening sized to receive a spring 64 and rod 50 therein. In yet another embodiment, rather than having recesses 76 positioned on arms 70 and 72, opposing pins could project inward from arms 70 and 72. Matching slots could then be formed at the ends of first and second fingers 66 and 68. Finally, in yet another example, recess 76 could be replaced with open grooves which would allow first and second fingers 66 and 68 to be slid into the grooves and thus eliminate the need for spring 64.

Removing housing 10 from holder 12 is accomplished by sliding first finger 66 backing into rod 50 and out of recess 76. This can be accomplished by grabbing first finger 66 between arm 70 and first end wall 14 or by grabbing first finger 66 through opening 36 in sidewall 18.

It is emphasized that one of the novel features of the present invention is that housing 10 can be mounted to a conventional toilet paper holder without modification. The term "conventional" as used in the specification and appended claims is interpreted to mean toilet paper holders known to those in the art that use a collapsible rod member to secure the toilet paper to the holder.

Door 28 is continually urged by a spring 78 extending between rod 50 and door 28 so that leading edge 42 is urged against second lip 34. Once roll 46 is received within chamber 24, door 28 can be raised using handles 51 positioned on door 28. With door 28 raised, leading end 47 of roll 46 can be pulled through opening 36. Door 28 can then be substantially closed.

In one embodiment, the present invention also provides means for sealing opening 36 extending through sidewall 18. As depicted in FIG. 2, elongated gaskets 79 and 80 are positioned along leading edge 42 and second lip 34, respectively. As such, spring 78 biases gaskets 79 and 80 on opposing sides of leading end 47 of roll 46 so as to substantially seal opening 36. Gaskets 79 and 80 are preferably made from a relatively soft sealing material such a rubber that will make a good seal between leading end 47 and the gaskets 79 and 80. The material, however, must be sufficiently smooth to allow the toilet paper to be pulled therebetween. In this embodiment, leading edge 47 of roll 46 can be pulled from housing 10 when door 28 is closed.

Figure 4:
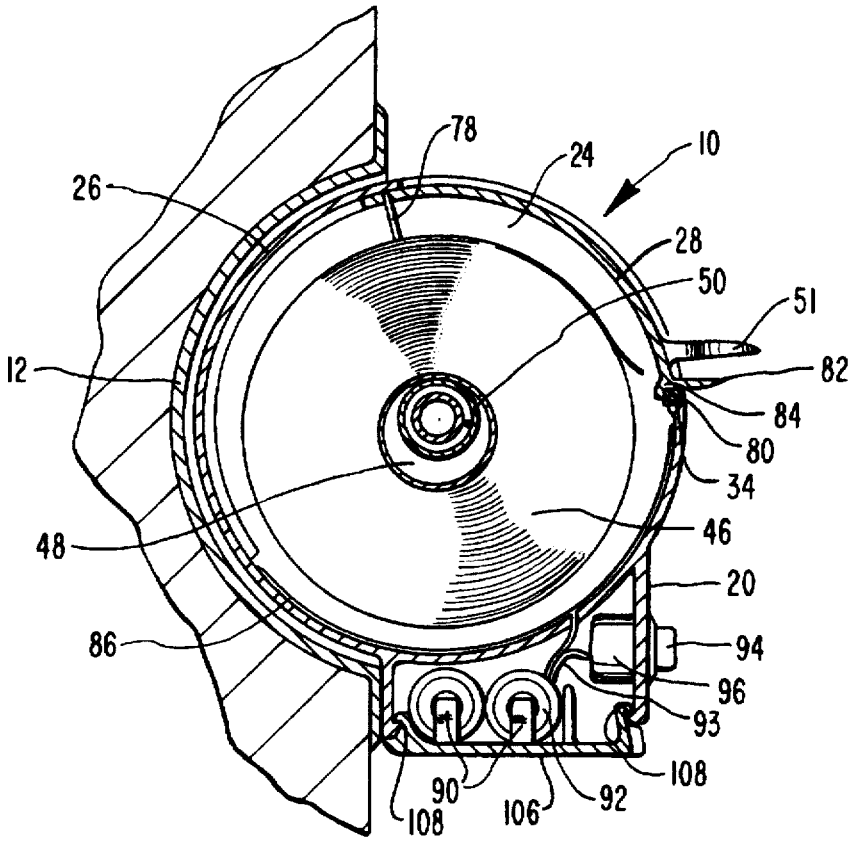
FIG. 4 is a cross-sectional view of the housing shown in FIG. 1 revealing a compartment housing batteries.
Figure 5:
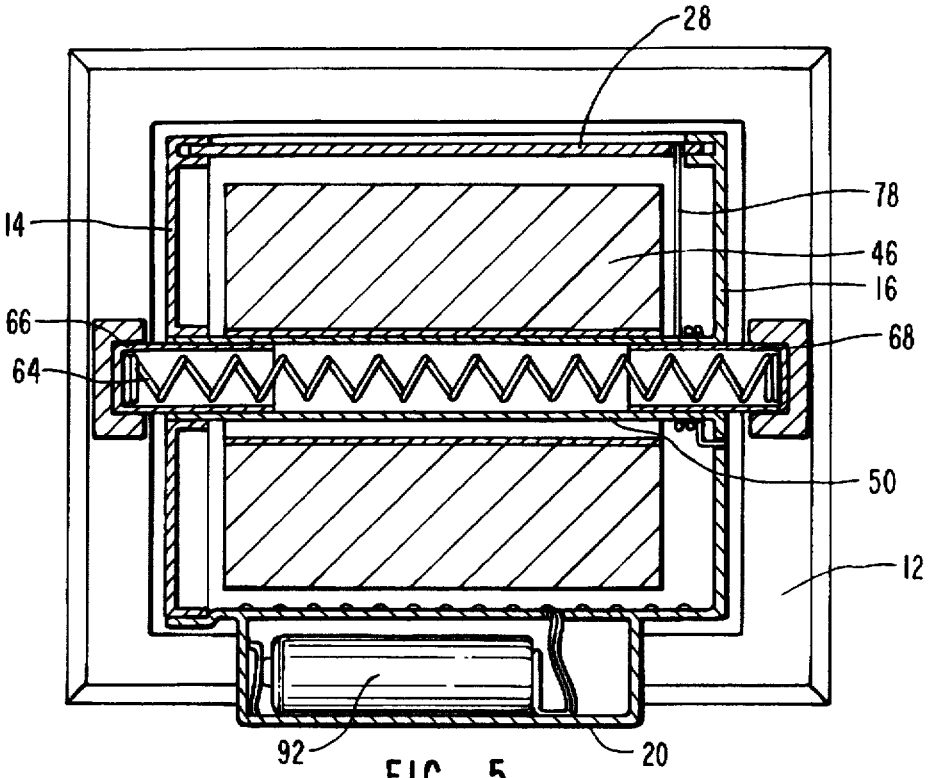
FIG. 5 is cross-sectional front view of the housing shown in FIG. 1.

In an alterative embodiment, as shown in FIG. 4, gasket 80 is positioned along second lip 34 while a rigid L-shaped sealing member 84 is positioned along leading edge 42. Sealing member 84 is positioned to overlap gasket 80 when door 28 is closed to tightly seal opening 36. During use, door 28 is opened allowing a desired quantity of the toilet paper to be removed from roll 46. At the end of use, door 28 is closed, completely sealing toilet paper 46 back within holding chamber 24.

As shown in FIG. 2, a jagged edge 82 is positioned adjacent to leading edge 42 of door 28. After a desired amount of toilet paper is unrolled from roll 46, the paper can be pulled across edge 82 to separate the paper for use. FIG. 3 shows an alternative embodiment in which jagged edge 82 is positioned on C-shaped tube 26 at second lip 34. In yet another alternative embodiment or in conjunction with jagged edge 82, perforations can be made across the toilet paper of roll 46 to allow easy separation of the desired amount of paper.

The present invention also provides means attached to housing 10 for heating roll 46 of moistened toilet paper within chamber 24 prior to being dispensed. Referring to FIG. 2, a heating pad 86 is mounted on interior surface 30 of C-shaped tube 26. Heating pad 86 can comprise a plurality of configurations. By way of example and not by limitation, heating pad can comprise a mat 87 having heating wires 88 encased therein. Wires 88 are preferably encased to prevent direct contact with the moisture from roll 46. Mat 87 can be made from materials such as rubber, plastic, ceramic, metal, or other materials that will not melt when wires 88 are energized. The temperature of wires 88 are not expected to exceed about 150° F. since the present invention is only designed to warm the pre-moistened toilet paper. Wires 88 can be any conventional type of heating filaments.

The present invention also provides means for energizing the means for heating the toilet paper. As depicted in FIG. 4, compartment 20 includes battery terminals 90 for attachment with batteries 92 that are in electrical communication by wires 93 with heating pad 86. A switch 94 selectively actuates energizing of heating pad 86 by batteries 92. In an alternative embodiment, a timer 96 can also be used to selectively time the length at which heating pad 86 is energized so as to save on the power consumption of batteries 92. In an alternative embodiment, the means for energizing the heating element could comprise an electrical cord in electric communication with heating pad 86. The electrical cord is designed to be plugged into a conventional outlet.

Figure 6:
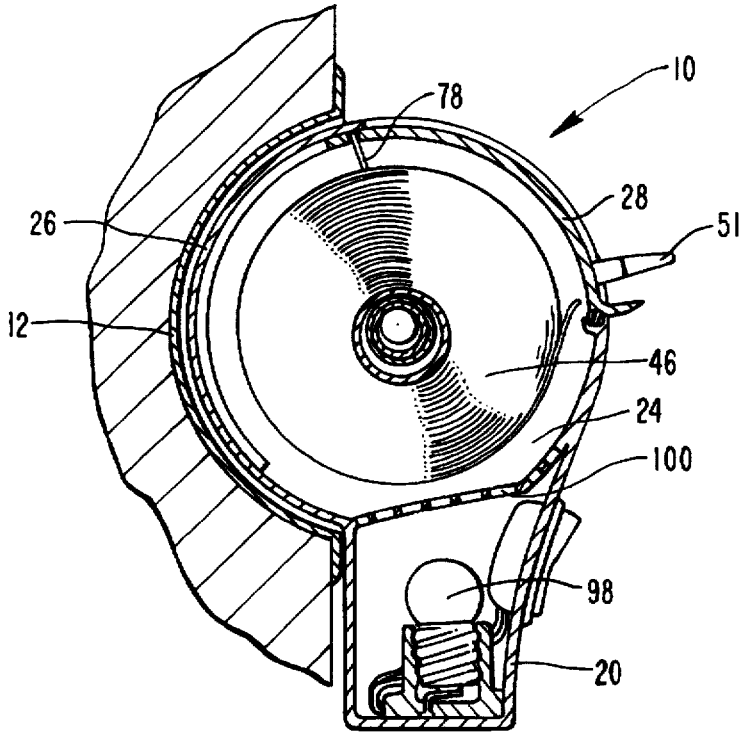
FIG. 6 is a cross-sectional side view of an alternative embodiment of the housing shown in FIG. 1 in which a light bulb is used to heat the toilet paper.

As depicted in FIG. 6, an alternative embodiment of the means for heating roll 46 can comprise compartment 20 being in open communication with chamber 24 and a light bulb 98 being positioned within compartment 20. When light bulb 98 is energized, such as by batteries 92 or an electrical cord connected to an outlet, light bulb 98 radiates heat that heats roll 46. In the preferred embodiment, a perforated shield 100 is positioned between light bulb 98 and roll 46. Perforated shield 100 allows heat to transfer between bulb 98 and roll 46 but prevent direct contact between bulb 98 and roll 46.

By using light bulb 98, door 28 can be made of a translucent material so as to provide a night light when light bulb 98 is energized. Alternatively, a portion 104 of compartment 20, as shown in FIG. 3, can be formed of a translucent material to also form a night light.

Finally, the present invention also provides means for accessing compartment 20. As illustrated in FIG. 4, compartment 20 comprises a base plate 106 that is selectively mounted to compartment 20 by clips 108. In this embodiment, base plate 106 can be removed to allow replacement of batteries 92 or light bulb 98.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for dispensing a roll of flushable, pre-moistened toilet paper, the apparatus comprising:

a. a housing having an interior surface defining a chamber, the chamber being sized to receive the pre-moistened toilet paper roll, the chamber being substantially sealed to substantially prevent evaporation of the moisture on the toilet paper roll;

b. means for selectively forming an opening in the housing through which the pre-moistened toilet paper can be dispensed;

c. means positioned within the chamber for holding the toilet paper roll so that the toilet paper roll freely rotates as the toilet paper is dispensed; and d. means attached to the housing for heating the pre-moistened toilet paper within the chamber prior to being dispensed.

2. An apparatus as recited in claim 1, wherein the housing further comprises a first end wall, an opposing second end wall, and a tubular sidewall extending therebetween.

3. An apparatus as recited in claim 2, wherein the first end wall is removable to define an access for insertion of the toilet paper into the chamber.

4. An apparatus as recited in claim 2, wherein the toilet paper roll has a passageway longitudinally extending therethrough and the means for holding the pre-moistened toilet paper roll comprises a rod longitudinally secured to at least one of the first and second end walls, the rod being sized to fit within the passageway in the toilet paper roll.

5. An apparatus as recited in claim 1, wherein means for selectively forming an opening in the housing comprises:

a. a C-shaped tube having a first lip and an opposing second lip defining the opening extending therebetween;

b. a door slidably mounted on the C-shaped tube to selectively cover the opening on the C-shaped tube.

6. An apparatus as recited in claim 5, wherein the housing further comprises a spring attached to the door to continually bias the door to cover the opening.

7. An apparatus as recited in claim 1, further comprising a conventional toilet paper holder having a pair of retaining arms, the housing being sized to fit between the retaining arms.

8. An apparatus as recited in claim 1, further comprising means for substantially sealing the opening in the housing.

9. An apparatus as recited in claim 1, further comprising a jagged ridge position on the housing adjacent to the opening.

10. An apparatus as recited in claim 1, wherein the means for heating the pre-moistened toilet paper comprises a heating pad secured on the interior surface of the housing.

11. An apparatus as recited in claim 1, wherein the means for heating the pre-moistened toilet paper comprises:

(a) a compartment extending off the chamber of the housing, the compartment being in communication with the chamber; and (b) a light bulb housed within the compartment.

12. An apparatus as recited in claim 11, wherein a portion of the housing is translucent to form a night light when the light bulb is energized.

13. An apparatus as recited in claim 1, further comprising means for energizing the means for heating the pre-moistened toilet paper.

14. An apparatus as recited in claim 13, wherein the means for energizing comprises batteries in electrical communication with the means for heating.

15. An apparatus as recited in claim 1, further comprising a timer attached to the means for heating the pre-moistened toilet paper.

16. An apparatus as recited in claim 1, wherein the toilet paper is pre-moistened with a bacterial static agent.

17. An apparatus as recited in claim 1, wherein the toilet paper is pre-moistened with a lotion.

18. An apparatus for dispensing a roll of flushable, pre-moistened toilet paper mounted on a conventional toilet paper holder, the conventional toilet paper holder having a pair of retaining arms spaced for holding a standard roll of toilet paper therebetween, the apparatus comprising:

a. a housing having:

i. a first end wall, an opposing second end wall, and a tubular sidewall extending therebetween, the first end wall and the second end wall being spaced to fit between the pair of retaining arms of the conventional toilet paper holder;

ii. an interior surface defining a chamber, the chamber being sized to receive the roll of pre-moistened toilet paper, the chamber also being substantially sealed to substantially prevent evaporation of the moisture on the toilet paper; and iii. an opening extending through a portion of the housing, the opening being sizeable to enable dispensing of the pre-moistened toilet paper in the chamber through the opening;

b. means positioned within the chamber for holding the roll of pre-moistened toilet paper so that the roll of pre-moistened toilet paper freely rotates as the toilet paper is dispensed; and c. means for selectively securing the housing to the retaining arms of the conventional toilet paper holder.

19. An apparatus as recited in claim 18, wherein the first end wall is removable to define an access for insertion of the toilet paper into the chamber.

20. An apparatus as recited in claim 18, wherein the sidewall further comprises:

(a) a C-shaped tube having a first lip and an opposing second lip defining the opening extending therebetween;

(b) a door slidably mounted on the C-shaped tube to selectively cover the opening on the C-shaped tube.

21. An apparatus as recited in claim 18, wherein the roll of toilet paper has a passageway longitudinally extending therethrough and the means for holding the roll of pre-moistened toilet paper comprises a rod longitudinally secured to at least one of the first and second end walls, the rod being sized to fit within the passageway in the toilet paper.

22. An apparatus as recited in claim 21, wherein the means for selectively securing the housing to the retaining arms comprises a pair of fingers individually projecting from the first end wall and the second end wall, at least one of the fingers being resiliently compressible.

23. An apparatus as recited in claim 18, further comprising means attached to the housing for heating the pre-moistened toilet paper within the chamber prior to being dispensed.

24. An apparatus as recited in claim 23, wherein the means for heating the pre-moistened toilet paper comprises a heating pad secured on the interior surface of the housing.

25. An apparatus as recited in claim 23, wherein the means for heating the pre-moistened toilet paper comprises:

(a) a compartment extending off the chamber holding the pre-moistened toilet paper, the recess being in communication with the chamber; and (b) a light bulb housed within the recess.

26. An apparatus as recited in claim 23, further comprises batteries attached to the housing, the batteries being in electrical communication with means for heating the pre-moistened toilet paper.

27. An apparatus as recited in claim 23, further comprising a timer attached to the means for heating pre-moistened toilet paper.

28. A system for dispensing toilet paper, the system comprising:

a. a roll of toilet paper being at least partially saturated with an aqueous bacterial static agent, the toilet paper having sufficient strength to be selectively unrolled without substantially decomposing;

b. a housing having:

i. an interior surface defining a chamber, the chamber being sized to receive the roll of the toilet paper saturated with the bacterial static agent, the chamber being substantially sealed to substantially prevent evaporation of the aqueous bacterial static agent on the toilet paper; and ii. an opening extending through a portion of the housing, the opening being sizeable to enable dispensing of the toilet paper in the chamber through the opening; and c. means positioned within the chamber for holding the roll of toilet paper so that the roll of toilet paper freely rotates as the toilet paper is dispensed.

29. A system as recited in claim 28, wherein the bacterial static agent is chlorhexidine.

30. A system as recited in claim 28, wherein the housing further comprises a first end wall, an opposing second end wall, and a tubular side wall extending therebetween.

31. A system as recited in claim 30, wherein the sidewall further comprises:

(a) a C-shaped tube having a first lip and an opposing second lip defining the opening extending therebetween;

(b) a door slidably mounted on the C-shaped tube to selectively cover the opening on the C-shaped tube.

32. A system as recited in claim 30, wherein the system further comprises:

(a) the roll of toilet paper having a passageway longitudinally extending therethrough; and (b) a rod longitudinally secured to at least one of the first and second end walls, the rod being sized to fit within the passageway in the toilet paper.

33. A system as recited in claim 30, wherein the housing is selectively secured to retaining arms via a pair of fingers individually projecting from the first end wall and the second end wall, at least one of the fingers being resiliently compressible.

34. A system as recited in claim 28, further comprising means attached to the housing for heating the toilet paper within the chamber prior to being dispensed.

35. A system as recited in claim 34, wherein the means for heating the toilet paper comprises a heating pad secured on the interior surface of the housing.

36. A system as recited in claim 34, wherein the means for heating the toilet paper comprises:

a. a recess extending off the chamber holding the premoistened toilet paper, the recess being in communication with the chamber;

b. a light bulb housed within the recess; and means for energizing the light bulb so that heat emanating for the light bulb heats the toilet paper.

* * * * *